US009708678B2

(12) United States Patent
Löcker

(10) Patent No.: US 9,708,678 B2
(45) Date of Patent: Jul. 18, 2017

(54) METHOD FOR PRODUCING A FORMED AND AT LEAST REGIONALLY HARDENED SHEET METAL COMPONENT

(71) Applicant: Kirchhoff Automotive Deutschland GmbH, Attendorn (DE)

(72) Inventor: Markus Löcker, Finnentrop (DE)

(73) Assignee: Kirchhoff Automotive Deutschland GmbH, Attendorn (DE)

( * ) Notice: Subject to any disclaimer, the term of this patent is extended or adjusted under 35 U.S.C. 154(b) by 324 days.

(21) Appl. No.: 14/404,927

(22) PCT Filed: Jul. 10, 2013

(86) PCT No.: PCT/EP2013/064596
§ 371 (c)(1),
(2) Date: Dec. 1, 2014

(87) PCT Pub. No.: WO2014/012831
PCT Pub. Date: Jan. 23, 2014

(65) Prior Publication Data

US 2015/0144232 A1 May 28, 2015

(30) Foreign Application Priority Data

Jul. 17, 2012 (DE) ..... 10 2012 106 405

(51) Int. Cl.
*C21D 8/00* (2006.01)
*C21D 6/00* (2006.01)
(Continued)

(52) U.S. Cl.
CPC ..... *C21D 8/0221* (2013.01); *B21D 22/022* (2013.01); *B21D 28/26* (2013.01);
(Continued)

(58) Field of Classification Search
None
See application file for complete search history.

(56) References Cited

FOREIGN PATENT DOCUMENTS

| | | | |
|---|---|---|---|
| CN | 101486060 | A | 7/2009 |
| DE | 102004019693 | A1 | 11/2005 |
| EP | 2062664 | A1 | 5/2009 |

OTHER PUBLICATIONS

Machine-English translation of CN101486060A, Li Huiping et al., Jul. 7, 2009.*

(Continued)

*Primary Examiner* — Deborah Yee
(74) *Attorney, Agent, or Firm* — Polson Intellectual Property Law, PC; Margaret Polson

(57) ABSTRACT

The invention relates to a method for producing a shaped and at least regionally hardened sheet metal component, particularly a sheet steel component (15), with at least one perforation (16) produced in it, in which method a preform (13) is heated to forming temperature, subsequently shaped and then at least regionally hardened by corresponding cooling, wherein the at least one perforation (16) in the preform (13) is produced during the course of a punching process before the preform (13) is hardened. According to the invention, the metal piece (14) separated from the preform (13) by punching is fed back to its original position or a corresponding position in the perforation (16), remains there for the duration of the quenching process and is only pressed out during or after removal of the sheet steel component (13) from the die (1), in which it is held during quenching. The invention also describes a quench press die (1) for producing a shaped and at least regionally hardened sheet metal component, particularly a sheet steel component (15), with at least two die parts (2, 3) adjustable against one another for opening and closing the die (1) and with a punching device (7) comprising a punching die (8) for
(Continued)

producing a perforation (16) in a preform (13) located between the die parts (2, 3). The die part (2), against which the punching die (8) for producing the perforation (16) works, has a return punch (11), the actuation side of which points towards the punching die (8) and the axis of motion of which corresponds to the axis of motion of the punching die (8), such that a metal piece (14) separated from a preform (13) by means of said punching die (8) can be returned to the correct position, or approximately to the correct position in the perforation (16) produced in the preform (13) by the punching process to fill said perforation.

6 Claims, 4 Drawing Sheets

(51) Int. Cl.

| | |
|---|---|
| ***C21D 1/22*** | (2006.01) |
| ***C21D 1/20*** | (2006.01) |
| ***B21D 22/04*** | (2006.01) |
| ***B21D 28/26*** | (2006.01) |
| ***B21D 35/00*** | (2006.01) |
| ***C21D 8/02*** | (2006.01) |
| ***B21D 22/02*** | (2006.01) |
| ***C21D 1/18*** | (2006.01) |
| ***C21D 9/00*** | (2006.01) |
| ***C21D 9/46*** | (2006.01) |
| ***C22C 38/00*** | (2006.01) |

(52) U.S. Cl.

CPC ..... *B21D 35/001* (2013.01); *C21D 1/18* (2013.01); *C21D 8/0247* (2013.01); *C21D 8/0294* (2013.01); *C21D 9/0062* (2013.01); *C21D 9/46* (2013.01); *C22C 38/00* (2013.01)

(56) References Cited

OTHER PUBLICATIONS

English translation of the Written Opinion of the International Search Authority in related case PCT/EP2013/064596 dated Sept 30, 2013 (6 pages).
Written Opinion of the International Search Authority in related case PCT/EP2013/064596 dated Sep. 30, 2013 (6 pages).
International Search Report in related case PCT/EP2013/064596 dated Sep. 30, 2013 (3 pages—EN; 4 pages—DE).

* cited by examiner

METHOD FOR PRODUCING A FORMED AND AT LEAST REGIONALLY HARDENED SHEET METAL COMPONENT

BACKGROUND

The invention relates to a method for producing a formed and at least regionally hardened sheet metal component. In particular, a sheet steel component with at least one perforation produced in it and method by which a blank is heated to forming temperature, subsequently formed in a tool and then at least regionally hardened by corresponding quenching The at least one perforation is produced in the blank in the course of a punching process before the blank is hardened. The invention further relates to a press hardening tool for producing a formed and at least partially hardened sheet metal component with at least two tool parts that can be adjusted relative to one another for the opening and closing of the tool as well as with a punch device comprising a punching stamp for producing a perforation in a blank located between the tool parts.

Press hardening tools are used to shape and harden metal blanks. Depending on the design of the hardening method, a blank that has been preheated correspondingly to forming temperature is fed to the press hardening tool, formed therein and after the forming has taken place is cooled sufficiently rapidly for it to harden and thus be tempered. Such press hardening tools are used, for example, for the manufacture of structural components of motor vehicles. The blanks are typically sheet steel parts so that the structural components are sheet steel components. It is also possible to further form already preformed sheet steel plates in a press hardening tool and to subsequently temper them within the tool. In principle, the heating of the blank to its forming temperature, typically corresponding to the austenitization temperature if the blank is made of steel, can be carried out within the press tool. However, the blank is usually heated in an oven to the forming temperature and then introduced into the opened press hardening tool. The press hardening tool itself has at least two tool parts that can be adjusted by opening and closing. As a rule these are referred to as the die and punch. The die here represents the tool part at rest, relative to which the punch is used by means of a press for closing the tool and thus for forming the blank inserted therein. To temper the shaped blank within the press hardening tool, the two tool parts have coolant channels through which a coolant is pumped. After the termination of the quenching process to at least regional harden the shaped blank, the tool is opened and the metal sheet component is removed.

Application cases exist in which such sheet components that are produced by the above-described method using a press hardening tool are to have one or more perforations, sometimes also called passages. Such perforations can be produced in the sheet steel component after the step of press hardening. This occurs by laser machining, since, due to the hardness established by the manufacturing process, a punching of the hardened sheet component is problematic. However, laser machining for producing the at least one perforation can also be disadvantageous. This is because of the costs incurred for equipment and handling. In addition, due to the heat input during the laser treatment, the hardness originally achieved is decreased at least in the marginal areas encompassing the perforation.

From DE 10 2004 019 693 A1 a method and a device for manufacturing a hardened sheet steel component are known, in which, within the press tool, the at least one perforation is produced in the blank during the quenching by perforating the blank. In this method, the at least one perforation is produced in the blank at a time when the latter has not yet hardened or in any case not yet completely hardened. The hole perforating stamp is removed from the perforation immediately after producing the perforation, in order to prevent the blank from shrinking onto the punching stamp. Because of this, damage to the punching stamp which occurs if said punching stamp is pulled off or out of a blank that has shrunk onto it during the course of the quenching process should be avoided.

However, in reference to the method known from DE 10 2004 019 693 A1, it is considered disadvantageous that the peripheral geometry of the at least one perforation produced in the blank is not controlled during the quenching process. It is true that the blank is held between the closed tool parts during the quenching process. However, this does not prevent shrinkage, particularly an irregular shrinkage of the opening width of the perforation produced. In principle, shrinkage of the opening width of the perforation has to be tolerated. However, it would be desirable for such shrinkage to occur uniformly over the perimeter of the perforation. This is not ensured with the above-mentioned previously known method. Different shrinkage rates can occur, particularly in the case of perforations whose geometry deviates from the circular cross sectional shape.

An additional method for manufacturing a hardened sheet metal profile with a perforation is known from EP 2 062 664 A1. In the method described in this document, a region delimited by at least one cut edge is first cut, wherein the cut depth is smaller than the material thickness of the plate. Subsequently, the plate is heat formed and the cut area is pushed out after the heat forming along the cut edge. The cutting and the pushing out of the area are carried out in opposite directions, so that burr-free cut contours are obtained. In this method as well as the already described method for DE 10 2004 019 693 A1, shrinkage events cannot prevented.

SUMMARY

Starting from the above-discussed prior art, the invention is therefore based on the problem of further developing a method as mentioned initially and a press hardening tool as mentioned initially in such a manner that the above-described problem of irregular shrinkage of a perforation in a blank that has not yet completely hardened is counteracted.

The method-related problem is solved according to the invention by an initially mentioned method according to the preamble in which the punched out piece separated from the blank is fed back into the perforation and remains there for the duration of the quenching process. It is only at the time of or after removal of the sheet steel component that the punched out piece is pushed out of the tool in which it is held during the quenching.

The device-related problem is solved by an initially mentioned press hardening tool according to the preamble, in which the tool part against which the punching stamp works for the introduction of the perforation has a return stamp whose operating side faces the punching stamp and whose movement axis corresponds to the movement axis of the punching stamp. This is so that a punched out piece separated from a blank by means of the punching stamp can be fed back into the perforation introduced by the punching process into the blank, in the correct position or approximately correct position, to fill said perforation.

In the method according to the invention—and similarly for the claimed press hardening tool—the perforation is produced in the as yet unhardened blank. This is a time in the sequence of the process steps when the blank still has relatively soft material properties. Consequently, the perforation can be produced in the blank by a cutting process performed by punching. Consequently, the punched out piece is separated without material loss. This is in contrast to what occurs in laser processes, for example. The punched out piece fed back into the perforation immediately after the punching out of the perforation is now used to counteract an irregular shrinkage of the perforation obtained in this manner. The punched out piece remains in the perforation at least until the end of the quenching process. Since the punched out piece fits precisely in the perforation and is thus fed back into the perforation, in its original position or in a corresponding position for filling the perforation, the punched out piece forms the place holder for the perforation produced. As a result of this an irregular shrinkage and thus an undesired change in the peripheral geometry of the perforation is effectively counteracted. The punched out piece itself naturally consists of the same material as the blank. Consequently, said punched out piece shrinks to the same extent as the blank. Therefore in this process, no or at most only insignificant shrinkage onto the punched out piece occurs and the latter can be removed from the perforation without problem after the end of the quenching process. Finally, there is no material bonding between the punched out piece and the surrounding material of the sheet steel component.

It is preferable to carry out the above-described process steps in such a manner that the punched out piece exiting the blank is returned with the return stroke of the punching stamp immediately after the termination of the punch stroke into the perforation. Because of this it is advantageous to use a return stamp which is arranged in the tool part in which the punching stamp is not arranged. Here as a result of the punch stroke of the punching stamp and the resulting translation motion of the punched out piece, the return stamp in contact with the side of the punched out piece that is opposite from the punching stamp is moved back into its starting position, in order to be activated after the completion of the punch stroke, as a result of which the punched out piece is fed back into the perforation. This return motion can be used in order to bring the punching stamp itself back into its starting position. After feeding the punched out piece back into the perforation, it is advantageous for both the punching stamp and also the return stamp to be in contact with the punched out piece, because as a result the position of the punched out piece within the perforation is fixed for the quenching process.

According to an embodiment, it is provided that the cross-sectional geometry of the return stamp corresponds in terms of its section in contact with the punched out piece to the perforation geometry and thus to the geometry of the punched out piece. In such a design, the return stamp is in contact with the punched out piece over the entire surface, so that the punched out piece is exposed to the same or at least substantially the same quenching conditions as the marginal regions of the perforation adjoining it. In such an embodiment, the press hardening tool can also be used to produce sheet steel components that do not necessarily have a perforation, and hence the step of separating a punched out piece from it is not carried out. Nevertheless, the region in which a perforation could be introduced is still exposed to the same or at least approximately the same quenching conditions as the adjoining regions, so that no noteworthy differences in strengths can be detected in spite of the provision of the punching and return device. Thus, using the above-described concept, a press hardening tool can be produced by means of which sheet steel components with or without perforations can be produced, without having to change the tool geometry or certain inserts. It is understood that such a press hardening tool can also comprise more than one punching device with in each case a return stamp associated with it.

In addition to the already indicated advantages that the claimed concept entails, it becomes obvious that with this concept the punched out piece does not have to be separated from the press hardening tool. Slug channels for the separation of a punched out piece are therefore in principle not needed. This in turn promotes the above-described uniform quenching conditions throughout the perforation.

BRIEF DESCRIPTION OF THE DRAWINGS

Additional advantages and embodiments of the invention result from the following description of an embodiment example in reference to the appended figures.

DETAILED DESCRIPTION

Figure 1:
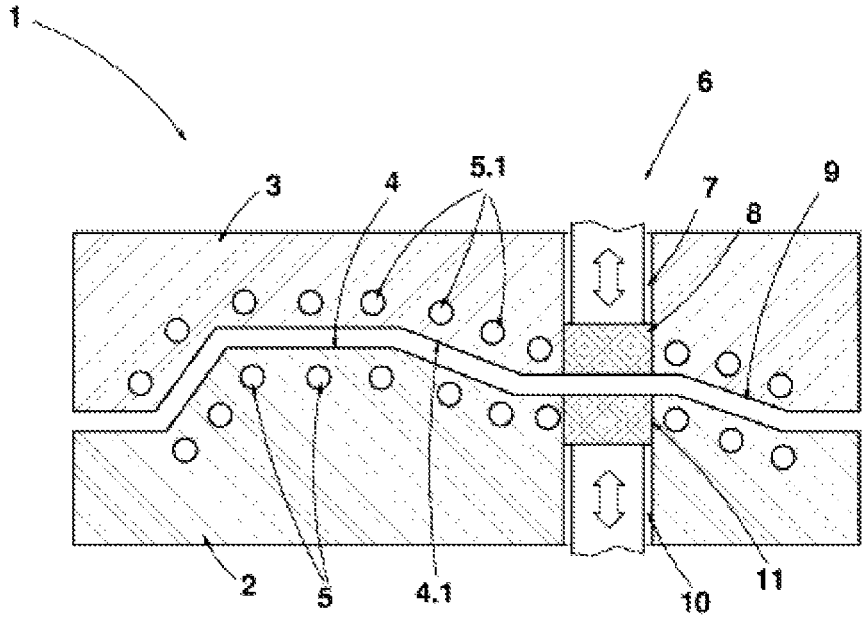
FIG. 1: shows a diagrammatic cross section through a press hardening tool with a device for producing a perforation in a workpiece held in the press hardening tool.

A press hardening tool 1 represented only diagrammatically in FIG. 1 has two tool parts 2, 3 that can be adjusted relative to one another. The tool part 2 is a stationary tool part, which therefore can also be referred to as a die. The tool part 3 can be moved in translation relative to the tool part 2. This tool part 3 can also be referred to as a stamp. Each of the two tool parts 2, 3 has a forming surface 4, 4.1. A blank, typically a steel plate heated beforehand to forming temperature in an oven, is inserted onto the forming surfaces 4, 4.1, of the opened press hardening tool 1 and where it is formed. For carrying out a hardening process, the tool parts 2, 3 have coolant channels 5, 5.1, by means of which, heat can be removed from the formed blank by appropriate rapid quenching. If a quenching is desired, coolant is run through the coolant channels 5, 5.1. To that extent, the press hardening tool 1 is a press hardening tool as is known.

In addition to the otherwise conventional devices that a press hardening tool has, the press hardening tool 1 moreover has a device 6 for producing a perforation in a blank held between the tool parts 2, 3. This device 6 comprises a punching device 7 with a punching stamp 8, punching device 7 which is associated in the represented embodiment example with the stamp 3. The punching stamp 8 can be moved in translation, as indicated with the double arrow in FIG. 1, in a manner which is not represented in further detail. The end side of the punching stamp, facing the forming cavity 9, is used for punching out a piece of the blank held between the tool parts 2, 3. In the represented embodiment example, the punching stamp 8 has a circular cross-sectional geometry. It is understood that the punching stamp 8 can have any cross-sectional geometries. The device 6 is moreover associated with a return device 10 with a return stamp 11. The return device 10 is associated with the die 2 of the press hardening tool 1. The double arrow indicates that the return stamp 11 of the return device 10, which is otherwise not represented in further detail, can also be moved in translation direction, namely on the same movement axis as the punching stamp 8. The return device 10 is used to feed the punched out piece, which in the course of the production of a perforation has separated from the blank located in the course of a punching process in between the tool parts 2, 3, back into the produced perforation immediately after the punching process has taken place.

Figure 2:
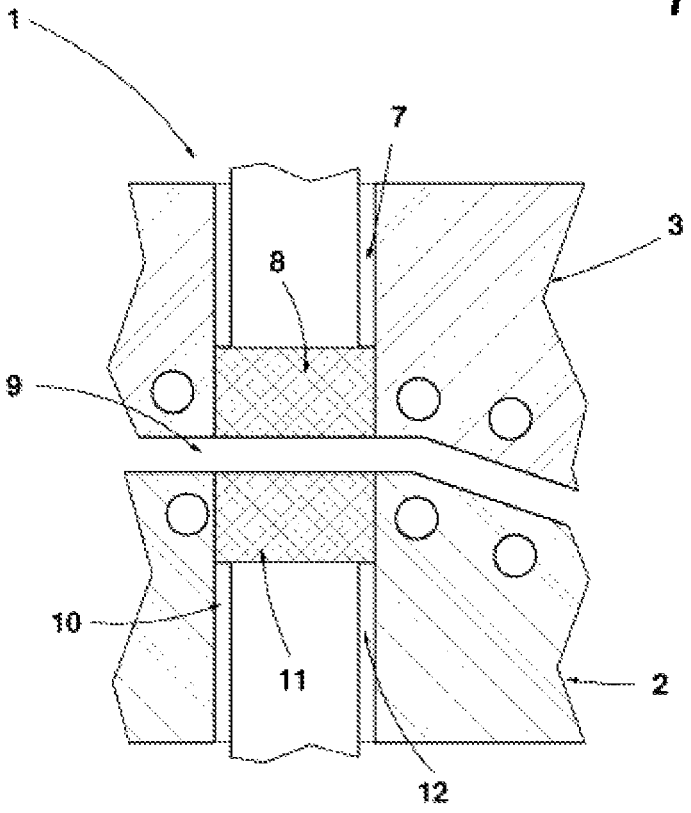
FIG. 2: shows an enlarged representation of the region of the device for producing a perforation of the press hardening tool of FIG. 1.

The punching device 7 and the return device 10 can be seen more clearly in the enlarged section representation of FIG. 2. The cross-sectional geometry of the return stamp 11 corresponds to the cross-sectional geometry of the punching stamp. The clear width of the movement channel 12 in which the return stamp 11 is moved is sufficiently large so that the punching stamp 8 can engage therein when the punch stroke is performed.

Figure 3:
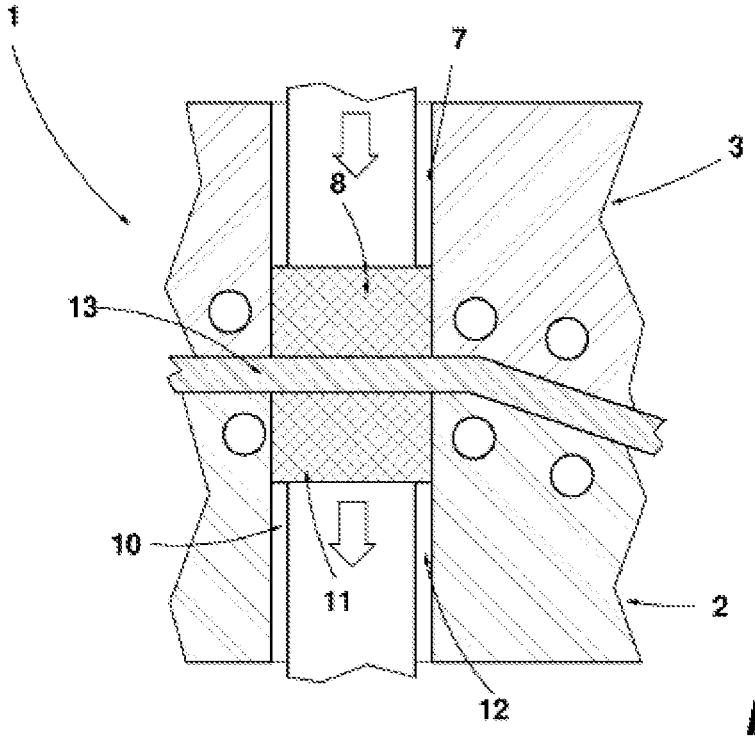
FIG. 3: shows the section of the press hardening tool of FIG. 2 with a blank held between the tool parts after the completion of the forming process.
Figure 4:
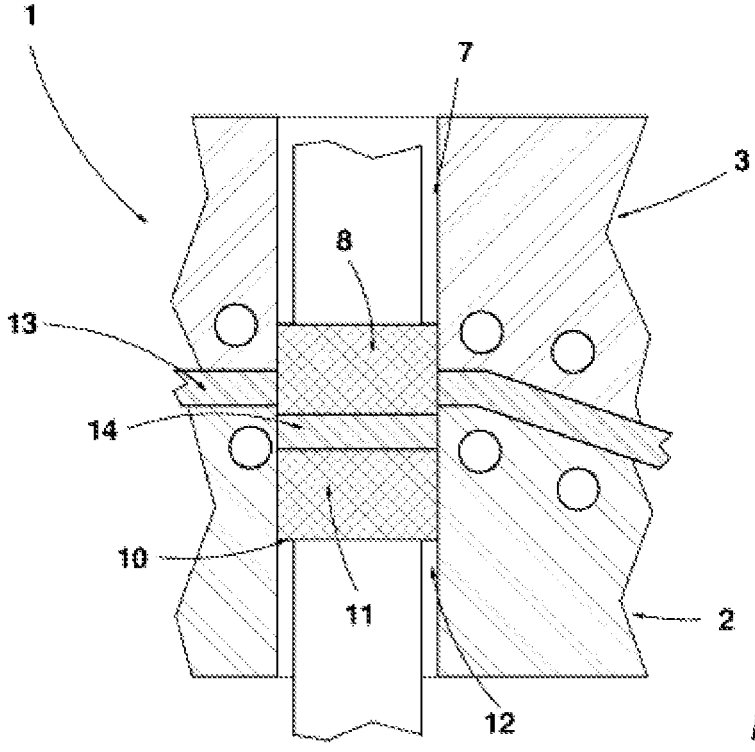
FIG. 4: shows the representation of FIG. 3 after the introduction of a perforation into the blank.
Figure 5A:
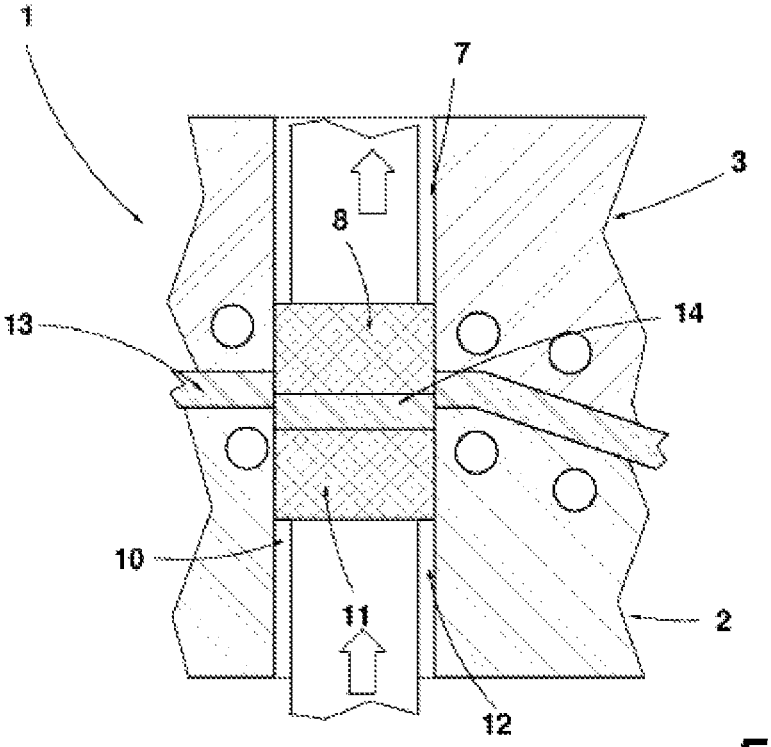
FIGS. 5*a*, 5*b*: show the press hardening tool in the section of FIG. 4 during and after a step of feeding the punched out piece back into the perforation produced in the blank.
Figure 5B:
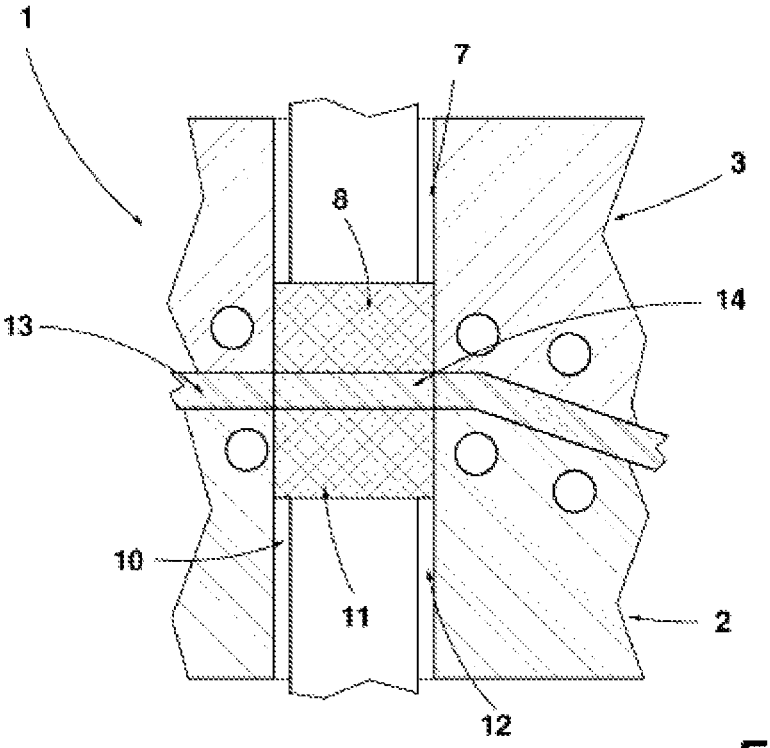
Figure 6:
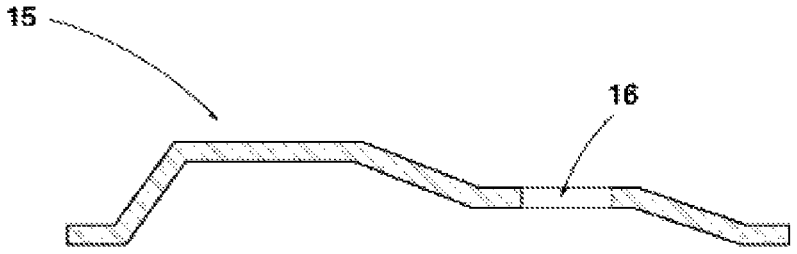
FIG. 6: shows, in a cross-sectional representation, the sheet steel component taken out of the press hardening tool, after the completion of the tempering process and after the pressing out of the punched out piece located previously in the perforation.

FIG. 3 shows the press hardening tool 1 in an enlarged representation thereof corresponding to that of FIG. 2 with a blank 13 which has been brought beforehand therein to forming temperature and which has already been formed by moving the tool parts 2, 3 together. The blank 13 is a sheet steel blank which has been heated before the forming process to the austenitization temperature. After the forming process has been completed and before coolant has been run through the coolant channels 5, 5.1 of the tool parts 2, 3, that is to say before the start of the hardening or tempering process, a perforation is produced in the blank 13. For this purpose, the punching stamp 8 is actuated in order to punch out a punched out piece, as indicated by the block arrow in FIG. 3. In the course of the punch stroke, the punched out piece 14 is separated from the blank 13 and it is pressed into the movement channel 12 of the return stamp 11. By means of this punch stroke, the return stamp 11 is simultaneously pressed back into its starting position. This situation is shown in FIG. 4. In terms of its material thickness, the punched out piece 14, is introduced completely into the movement channel 12. From this it becomes evident that the punched out piece 14 no longer has any material connection with the blank 13. Immediately after the completion of the punch stroke of the punching stamp 8, the return stamp 11 of the return device 10 is activated, as a result of which the punched out piece 14 is moved from the movement channel 12 back into the perforation introduced by the punching process into the blank 13. Due to the guiding of the punched out piece 14, which is in contact with its surface with the end side of the return stamp 11 and which is held on its other side by the punching stamp 8, said piece is pushed into the produced perforation in the correct and initial position, as said piece is separated from the blank 13, perforation in which the punched out piece 14 sits with precise fit. The steps of feeding the punched out piece 14 back into the perforation 16 are shown in FIGS. 5*a*, 5*b*, wherein FIG. 5*a* shows the situation in which the punched out piece 14 is being introduced into the perforation, while FIG. 5*b* shows the punched out piece 14 inserted into the perforation 16.

Subsequently, the active quenching process is started by running coolant through the coolant channels 5, 5.1. Due to the precise-fit seat of the punched out piece 14 within the perforation 16, said piece functions as a place holder and therefore ensures a uniform shrinkage of the entire region of the perforation and in particular of the marginal regions of the blank 13 encompassing the perforation, as a result of which preservation of the perforation geometry is ensured.

After the completion of the quenching process, the press hardening tool 1 is opened and the sheet steel component 15 produced therein is removed. The punched out piece 14 can also be pressed out of the perforation 16, including in particular by hand without problem. Subsequently the sheet steel component with the desired perforation and the intended dimensional accuracy is provided.

In the described embodiment example, the perforation 16 is produced in the blank 13 after the forming step has ended. Similarly, it is possible to provide for introducing the perforation while the forming process is in its end phase. The machine cycle for introducing the described perforation can be provided to be very short, so that the usual machine cycle for producing the sheet steel components in question is not increased or increased only barely noticeably.

In the embodiment example described in the figures, the punching device is associated with the stamp and the return device with the die. It is equally possible to associate the punching device with the die and the return device with the stamp. When several perforation production devices are provided, the punching devices and the return device can each be associated with the same tool part. It is also possible to associate at least one punching device as well as a return device with each tool part. The association of punching device and return device is implemented as a function of the construction circumstances of the tool. In addition it is possible to provide for the punching stamp and the return stamp of a perforation production device to be implemented so as to be able to perform both activities. Then, the punch stroke and the return stroke of the two stamps can be performed in the same way.

LIST OF REFERENCE NUMERALS

1 Press hardening tool
2 Tool part, die
3 Tool part, stamp
4, 4.1 Forming surface
5, 5.1 Coolant channel
6 Device
7 Punching device
8 Punching stamp
9 Forming cavity
10 Return device
11 Return stamp
12 Movement channel
13 Blank
14 Punched out piece
15 Sheet steel component
16 Perforation

The invention claimed is:

1. Method for producing a formed and at least regionally hardened sheet steel component, with at least one perforation produced in it, the method comprising the steps of:

heating a blank to forming temperature and subsequently forming the blank in a tool;

forming at least one perforation in the blank by a punching process before the blank is hardened;

feeding a punched out piece separated from the blank back to its original position in the perforation to remain there for the duration of a quenching process;

at least regionally hardening by corresponding quenching the blank; and pressing out the punched out piece either at the time of or after removal of the sheet steel component from the tool in which it is held during the quenching.

2. The method of claim 1, wherein the perforation is produced in the blank after the forming step or in an end phase of the forming step.

3. The method of claim 1, wherein an active quenching of the formed blank occurs after the steps of producing a perforation and feeding back the punched out piece into the perforation have been completed.

4. The method of claim 1, wherein at least one perforation is produced in a region of the blank which is subsequently hardened.

5. The method of claim 1, wherein the steps of producing the formed and at least regionally hardened sheet component are carried out in a press hardening tool.

6. The method of claim 1, wherein the punched out piece and the blank adjacent to the punched out piece shrink to substantially the same extent.

* * * * *